US010946536B2

(12) United States Patent
Winters et al.

(10) Patent No.: US 10,946,536 B2
(45) Date of Patent: Mar. 16, 2021

(54) ROTARY SHAVER HAVING A DISC-SHAPED ELEMENT

(71) Applicant: KONINKLIJKE PHILIPS N.V., Eindhoven (NL)

(72) Inventors: Josty Winters, Eindhoven (NL); Fokke Voorhorst, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 334 days.

(21) Appl. No.: 14/772,158

(22) PCT Filed: Jan. 28, 2015

(86) PCT No.: PCT/EP2015/051636

§ 371 (c)(1),
(2) Date: Sep. 2, 2015

(87) PCT Pub. No.: WO2015/124389

PCT Pub. Date: Aug. 27, 2015

(65) Prior Publication Data

US 2016/0346942 A1 Dec. 1, 2016

(30) Foreign Application Priority Data

Feb. 24, 2014 (EP) ..... 14156303

(51) Int. Cl.
*B26B 19/14* (2006.01)
*B26B 19/38* (2006.01)

(52) U.S. Cl.
CPC ..... *B26B 19/143* (2013.01); *B26B 19/146* (2013.01); *B26B 19/3853* (2013.01)

(58) Field of Classification Search
CPC .... B26D 19/14; B26D 19/143; B26D 19/145; B26D 19/146; B26D 19/148; B26B 19/3853
See application file for complete search history.

(56) References Cited

U.S. PATENT DOCUMENTS 3,466,966 A 9/1969 Brown
3,722,929 A * 3/1973 Gilman ..... B65H 75/08 242/571.5
4,261,243 A 4/1981 Palmer
D268,894 S 5/1983 Wollar
(Continued)

FOREIGN PATENT DOCUMENTS

DE 10111939 A1 11/2002
EP 1690654 A1 8/2006
(Continued)

*Primary Examiner* — Jason Daniel Prone
*Assistant Examiner* — Samuel A Davies

(57) ABSTRACT

A rotary shaver 1 comprises at least an external cutting element 7 and a disc-shaped element 10. The disc-shaped element covers at least part of the external cutting element. The external cutting element is at least provided with a passage 11. The disc-shaped element is at least provided with a pen 17 having a length, which pen is press-fitted in the passage. Between a wall 22 of the passage and the pen at least one vent 21 extends at least along the length of the pen. The pen is provided with at least three ribs 19 extending parallel to a central axis of the pen, wherein the at least one vent is located between adjacent ribs and the wall of the passage.

4 Claims, 6 Drawing Sheets

(56) References Cited

U.S. PATENT DOCUMENTS

| | | | | |
|---|---|---|---|---|
| 4,402,641 | A | 9/1983 | Arff | |
| D284,934 | S | 8/1986 | Okawa | |
| 4,728,238 | A * | 3/1988 | Chisholm | F16B 19/004 411/456 |
| 5,017,068 | A * | 5/1991 | Cooksey | F16B 23/0061 411/373 |
| 5,319,839 | A | 6/1994 | Shimajiri | |
| 5,797,714 | A * | 8/1998 | Oddenino | B60R 13/0206 411/508 |
| 6,422,348 | B1 * | 7/2002 | Jujo | G04B 5/14 185/39 |
| 7,356,929 | B2 * | 4/2008 | Nakano | B26B 19/141 30/346.51 |
| 2002/0020041 | A1 * | 2/2002 | Newman | A46B 17/02 16/427 |
| 2003/0070304 | A1 * | 4/2003 | Curello | B26B 19/14 30/346.51 |
| 2008/0236691 | A1 | 10/2008 | Roll | |
| 2009/0320295 | A1 * | 12/2009 | Shimizu | B26B 19/14 30/43.6 |
| 2012/0110854 | A1 * | 5/2012 | Nakano | B26B 19/143 30/43.5 |
| 2012/0217137 | A1 * | 8/2012 | Tabler | B65G 35/063 198/786 |
| 2013/0145629 | A1 * | 6/2013 | Murzynski | B26B 19/3893 30/346.51 |
| 2016/0346942 | A1 * | 12/2016 | Winters | B26B 19/143 |

FOREIGN PATENT DOCUMENTS

| | | | |
|---|---|---|---|
| GB | 678839 | A | 4/1951 |
| GB | 2046392 | A | 11/1980 |
| WO | 2006067710 | A1 | 6/2006 |
| WO | 2006067713 | A1 | 6/2006 |
| WO | 2008010139 | A1 | 1/2008 |
| WO | 2011055323 | A1 | 5/2011 |

* cited by examiner

ROTARY SHAVER HAVING A DISC-SHAPED ELEMENT

This application is the U.S. National Phase application under 35 U.S.C. § 371 of International Application No. PCT/EP2015/051636, filed on Jan. 28, 2015, which claims the benefit of European Application No. 14156303.1 filed on Feb. 24, 2014. These applications are hereby incorporated by reference herein.

FIELD OF THE INVENTION

The invention relates to a rotary shaver comprising at least an external cutting element, an internal cutting element being rotatable with respect to the external cutting element about an axis of rotation, and a disc-shaped element which covers at least part of the external cutting element.

BACKGROUND OF THE INVENTION

Such rotary shavers are known, wherein part of a metal external cutting element is hidden from view by a disc-shaped cap to improve the appearance of the rotary shaver. The disc-shaped cap is provided on the metal external cutting element, whereby openings and/or apertures in the metal external cutting element are hidden from view by the disc-shaped element, and a nice appearance is obtained.

It is known to connect the disc-shaped cap to the metal external cutting element by means of glue.

The application of glue requires additional process steps, such as cleaning the surfaces to be glued together, applying the glue, curing the glue etc.

Another disadvantage is that after applying the glue, the metal external cutting element and the disc-shaped cap with the glue between them will be moved by a transport belt towards an oven to harden the glue. During this time the disc-shaped cap might shift with respect to the metal external cutting element and may become eccentric because the glue is still liquid.

EP 1 690 654 A1 discloses a rotary shaver having an external cutting element with a central circular aperture, into which a cap is fixed. At its lower side, the cap comprises an engaging hole which engages a tip end of a rotatable inner cutter of the rotary shaver. The engagement of the tip end of the inner cutter with the engaging hole of the cap prevents axial vibration of the inner cutter.

WO 2006/067710 discloses a rotary shaver having an external cutting element provided with a central tube, which serves as a bearing to rotatably mount an internal cutter member of the rotary shaver. The external cutting element is provided with a cover plate which serves aesthetic purposes and/or provides feature information. The cover plate includes an integrated outlet nozzle of an additive supply system of the shaver via which an additive can be supplied to the skin during operation. The outlet nozzle extends through the central tube of the external cutting element.

SUMMARY OF THE INVENTION

In view of the above, a general object of the present invention is to provide a rotary shaver wherein a disc-shaped element can easily be connected to the external cutting element.

According to a first aspect, the invention provides a rotary shaver of the type mentioned in the opening paragraph, wherein the external cutting element is at least provided with a passage, whilst the disc-shaped element is at least provided with a pen having a length, which pen is press-fitted in the passage, wherein the passage of the external cutting element and the pen of the disc-shaped element extend coaxially with the axis of rotation, and wherein between a wall of the passage and the pen at least one vent extends at least along the length of the pen and parallel to a central axis of the pen, and wherein the pen is provided with at least three ribs extending parallel to the central axis of the pen, wherein the at least one vent is located between adjacent ribs and the wall of the passage.

When connecting the disc-shaped element to the external cutting element, the pen of the disc-shaped element is inserted and pushed into the passage of the external cutting element, whereby a press-fit is obtained due to which the disc-shaped element is firmly connected to the external cutting element. To remove the disc-shaped element from the external cutting element a force needs to be applied to the disc-shaped element to pull the pen out of the passage.

During use of the rotary shaver, the disc-shaped element and the external cutting element might heat up. During this heating up, air in the passage near an end of the pen will expand. To avoid that the pen will be pushed out of the passage due to the expanded air, at least one vent extends at least lengthwise along the pen. Through the at least one vent, air can flow to relief the air pressure in the passage. By virtue of the at least one vent, the press-fit connection between the disc-shaped element and the external cutting element is maintained, also when the disc-shaped element and the external cutting element are heated up.

The ribs are suitable for providing a press-fit-connection between the disc-shaped element and the external cutting element. By having at least three ribs, preferably regularly spaced on the circumference of the pen, automatic centering of the disc-shaped element with respect to the external cutting element will occur. Furthermore, by virtue of such axially extending ribs, vents extending lengthwise of the pen will be present between adjacent ribs. By choosing the number of axially extending vents and the size of each vent, the contact area between the disc-shaped element and the external cutting element and the total size of the vents can be optimized.

According to a further aspect, the invention provides a rotary shaver, wherein the ribs extend radially with respect to the central axis of the pen.

By virtue of such radially extending ribs, vents extending lengthwise along the pen will be present between adjacent ribs.

According to a further aspect, the invention provides a rotary shaver, wherein the disc-shaped element is made of plastic.

Such a plastic disc-shaped element can easily be made, for example by injection moulding, in any required dimension and colour, so that the appearance of the rotary shaver can easily be amended or changed by the user by replacing the plastic disc-shaped element by a plastic disc-shaped element of another colour or another shape.

According to a further aspect, the invention provides a rotary shaver, wherein the disc-shaped element is in contact with the external cutting element by means of a raised ring-shaped rim extending between a side surface of the external cutting element facing the disc-shaped element and a side surface of the disc-shaped element facing the external cutting element, which raised ring-shaped rim has a height of at least 0.1 millimetre in a direction parallel to a longitudinal direction of the pen and a width of less than 0.35 millimetre in a direction perpendicular to said longitudinal direction.

Due to said ring-shaped rim between the disc-shaped element and the external cutting element, said elements are located at a distance from each other which is larger than 0.1 millimetre. With such a distance between the disc-shaped element and the external cutting element, no crevice corrosion will occur in the case that the external cutting element and/or the disc-shaped element are made of metal. Since the rim itself is less than 0.35 millimetre wide, there will be no crevice corrosion at the rim either. Surface irregularities at the rim will allow venting. If pressure builds up, the disc-shaped element will be elastically deformed and will be "lifted up" a little bit, allowing air to escape.

According to a further aspect, the invention provides a rotary shaver, wherein the external cutting element comprises a central bearing member for supporting the internal cutting element radially with respect to the axis of rotation, and wherein an internal chamber of said central bearing member constitutes the passage.

The internal chamber of the central bearing member will be hidden from view by the disc-shaped element after the pen of the disc-shaped element has been inserted into the passage.

BRIEF DESCRIPTION OF THE DRAWINGS

The rotary shaver according to the invention will be further explained with reference to the drawings, wherein.

In the drawings, like reference numerals refer to like elements.

DESCRIPTION OF PREFERRED EMBODIMENTS

Figure 2:
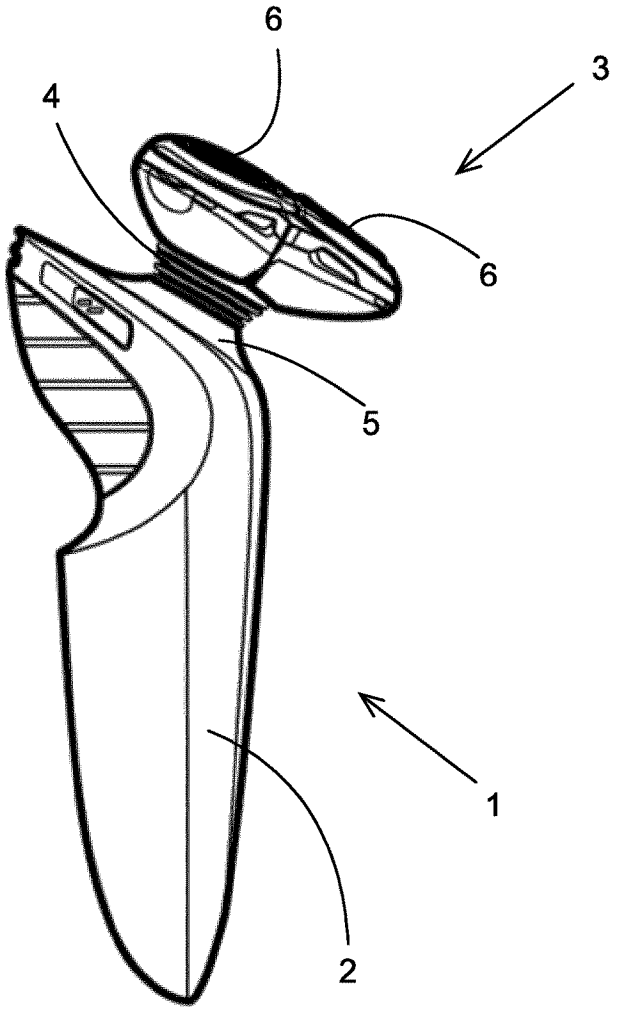
FIG. 2 is a side view of the rotary shaver as shown in FIG. 1.
Figure 1:
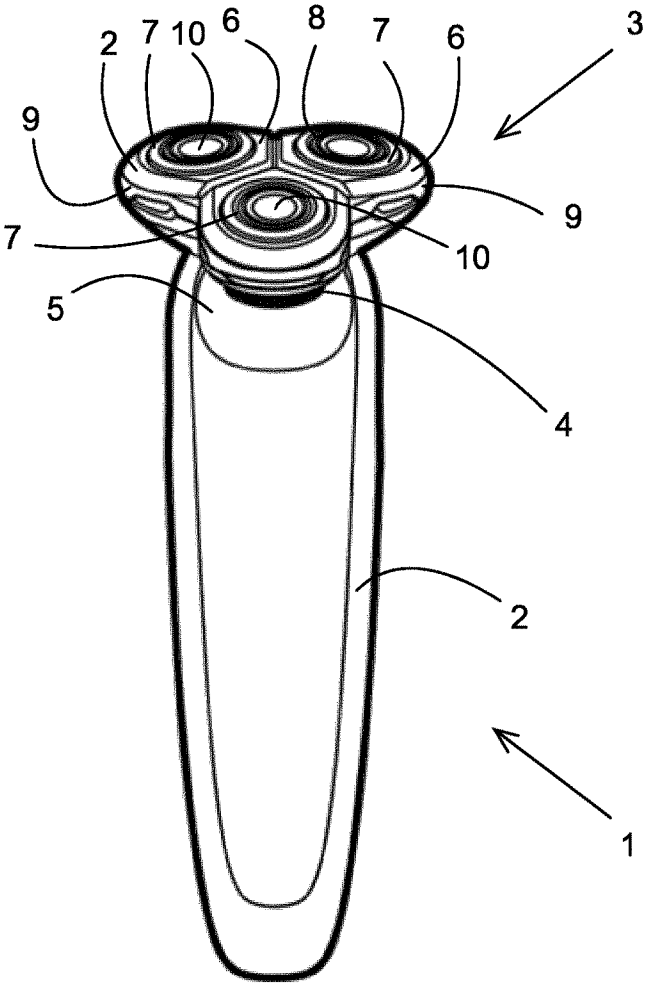
FIG. 1 is a perspective schematic view of a rotary shaver according to the invention.

FIGS. 1 and 2 show a rotary shaver 1 according to the invention. The shaver 1 comprises a main housing 2, which is suitable to be held by a user of the shaver. The shaver 1 further comprises a hair-cutting module 3, which is suitable to contact an area of skin having hairs to be shaved off and which can suitably be moved with respect to this area. The hair-cutting module 3 is connected to the main housing 2 through a central shaft member 4, wherein the connection of the hair-cutting module 3 to the main housing 2 may be detachable. Cross-sectional dimensions of the central shaft member 4 are considerably smaller than the cross-sectional dimensions of the hair-cutting module 3, and the hair-cutting module 3 is positioned at a certain distance from a top portion 5 of the main housing 2. Consequently, the connection between the main housing 2 and the hair-cutting module 3 has a slim appearance, wherein the hair-cutting module 3 has an elevated position with respect to the main housing 2. Due to this, when a user performs a shaving action by using the shaver 1, he may have a clear side view of the hair-cutting module 3.

The hair-cutting module 3 comprises three cutting units 6, which are arranged in a triangle formation. Within the scope of the present invention, the number of cutting units 6 may also be two or more than three. For the sake of completeness, it is noted that each of the cutting units 6 may be movably arranged to a certain extent, so as to facilitate each of them in following a contour of an area of skin to be shaved. For example, the cutting units 6 may be pivotable to a limited extent with respect to the central shaft member 4. Each cutting unit 6 comprises a metal external cutting element 7 which is arranged at a top side of the cutting unit 6, and which has a plurality of openings 8 for letting through hairs to be shaved off. The metal external cutting element 7 is pivotably connected to a base portion 9 of the cutting unit 6. Right underneath the external cutting element 7, on the inside of the cutting unit 6, a metal internal cutting element (not visible) is rotatably arranged. During operation, a central portion of the internal cutting element is pressed against the metal external cutting element 7 under spring force.

The internal cutting elements of the cutting unit 6 are driven, via gear wheels, by a main driving axle extending from a motor in the main housing 2 through the central shaft member 4 into the hair-cutting module 3.

The shaver 1 described so far is known from WO2011055323A1 and WO200810139A1, in the name of the current applicant.

The external cutting elements 7 of the cutting unit 6 are provided with plastic disc-shaped elements or caps 10, which have a decorative function.

Figure 3:
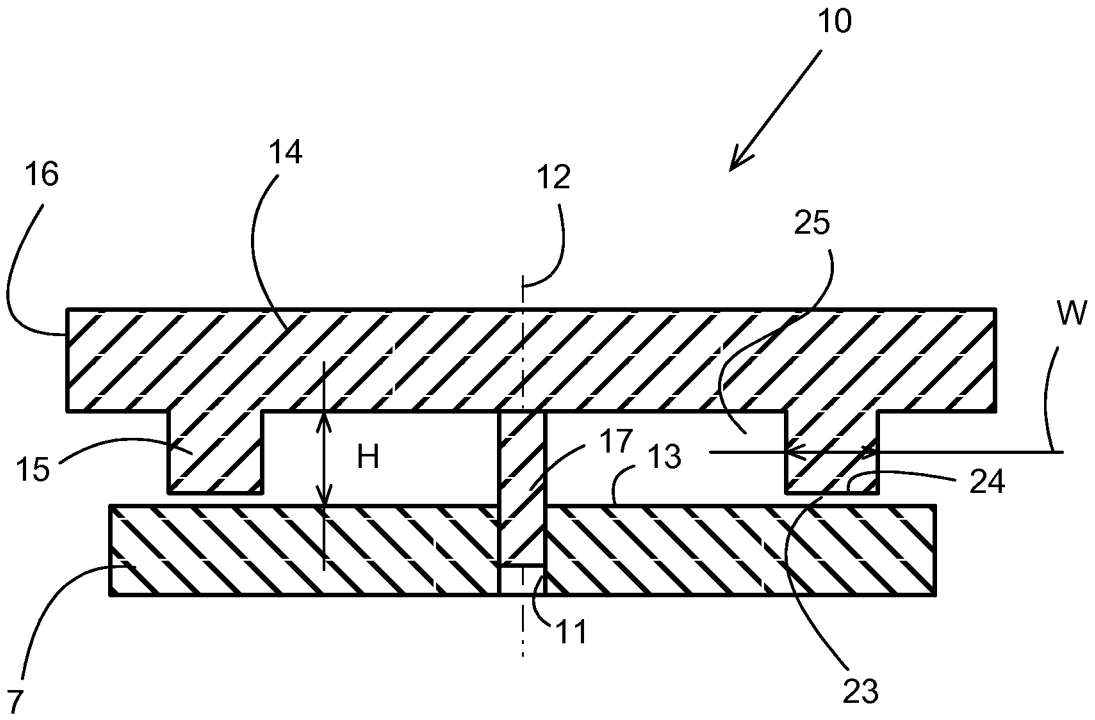
FIG. 3 is a schematic cross section of the rotary shaver as shown in FIG. 1.
Figure 4:
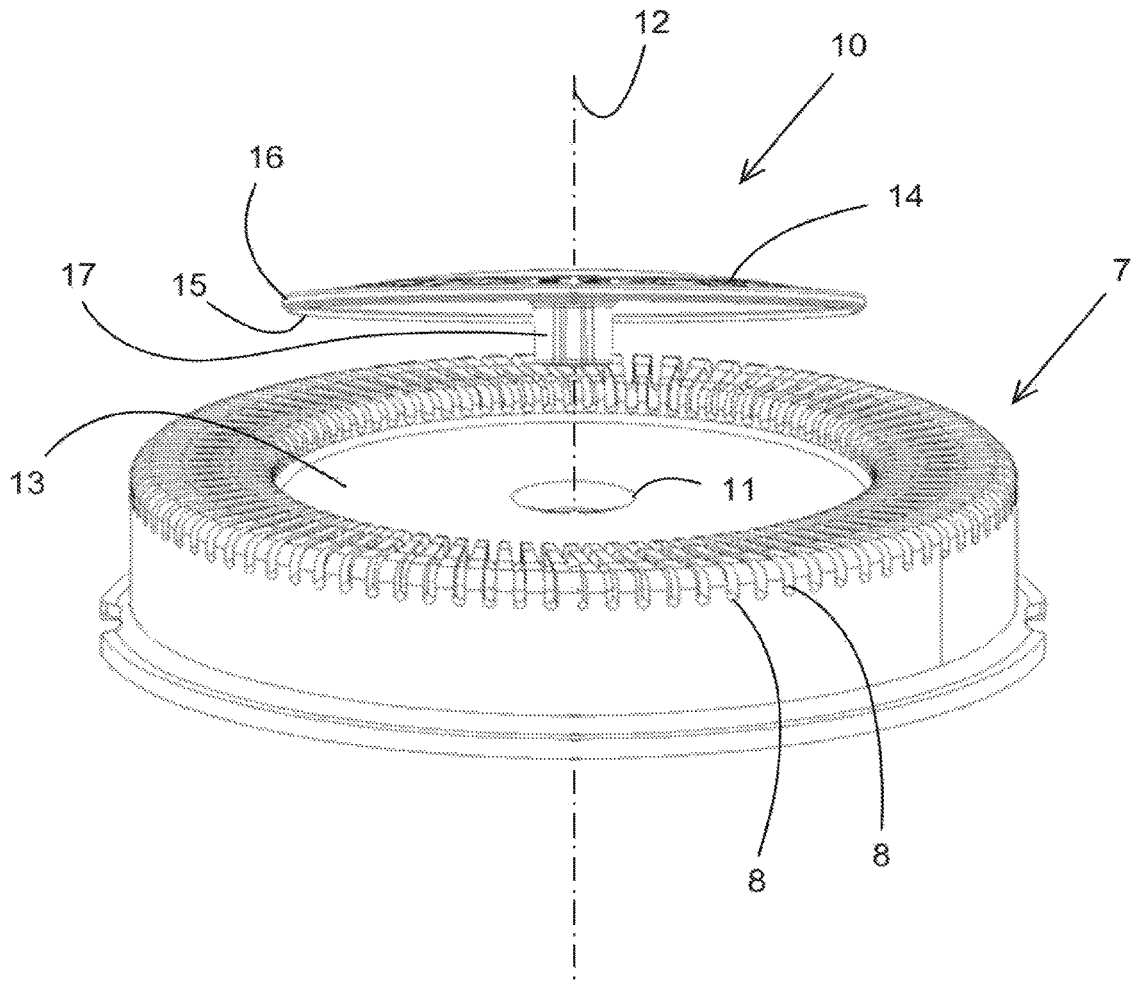
FIG. 4 is a perspective exploded view of an external cutting element and a disc-shaped element of the rotary shaver as shown in FIG. 1.

FIGS. 3 and 4 are a schematic cross section and a perspective exploded view, respectively, of the shaver 1, showing the metal external cutting element 7 and the plastic disc-shaped cap 10. The external cutting element 7 is provided with a centrally located cylindrical passage 11 extending along an axis 12. The axis 12 is coaxial with an axis of rotation of the internal cutting member. The external cutting element 7 comprises a central cylindrical bearing member for supporting the internal cutting element radially with respect to the axis 12. An internal chamber of said central bearing member constitutes the passage 11. The bearing member is not shown in detail in the figures, but is a well-known and common element of an external cutting element of rotary-type electric shavers. The axis 12 extends perpendicularly to a main external surface 13 of the external cutting element 7. The disc-shaped cap 10 comprises a disc-shaped covering member 14 as well as a continuous uninterrupted (endless) ring-shaped rim 15 extending symmetrically about the axis 12.

The rim 15 is located near a circumferential edge 16 of the disc-shaped covering member 14. The rim 15 extends from a side surface of the disc-shaped covering element 14 facing the external cutting element 7 towards the main external surface 13 of the external cutting element 7 facing the disc-shaped cap 10. The rim 15 has a width W in a direction radial to the axis 12 of less than 0.35 millimetre, preferably as small as possible. The rim 15 has a height H in a direction parallel to the axis 12 of at least 0.1 millimetre. Due to the rim 15, the cylindrical disc-shaped covering member 14 is kept at a distance H from the main external surface 13 of the external cutting element 7.

Due to the dimensions of the width W of the rim 15 and the distance H between the cylindrical disc-shaped covering member 14 of the disc-shaped cap 10 and the main external surface 13 of the external cutting element 7, crevice corrosion between the disc-shaped cap 10 and the main external surface 13 of the external cutting element 7 is prevented.

At the axis 12, the disc-shaped cap 10 is provided with a pen 17 extending perpendicularly to the cylindrical disc-shaped covering member 14. The pen 17 is press-fitted in the passage 11 of the external cutting element 7 to connect the disc-shaped cap 10 to the external cutting element 7.

Figure 5:
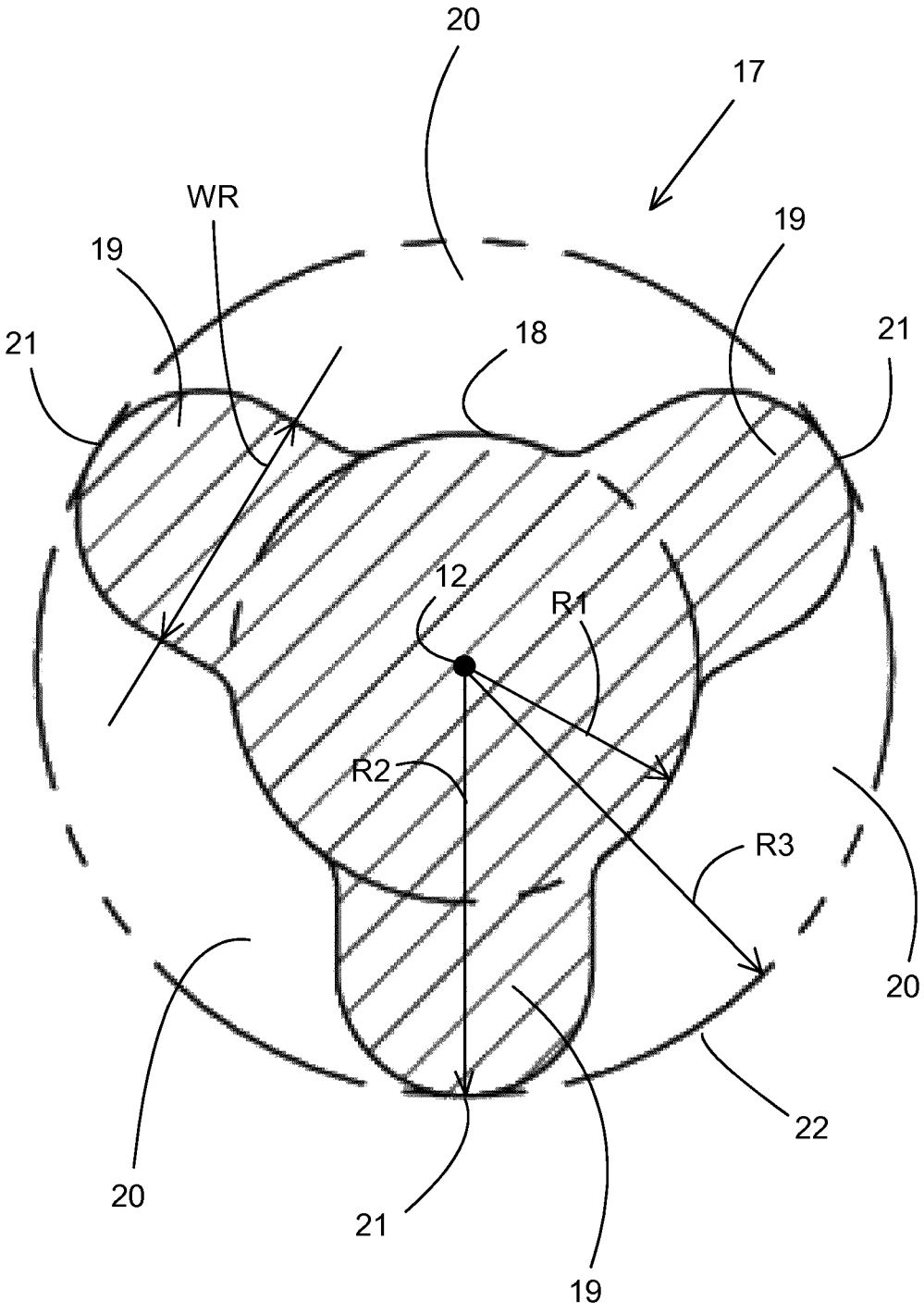
FIG. 5 is an enlarged cross section of a first embodiment of a pen of the disc-shaped element as shown in FIG. 4.
Figure 6:
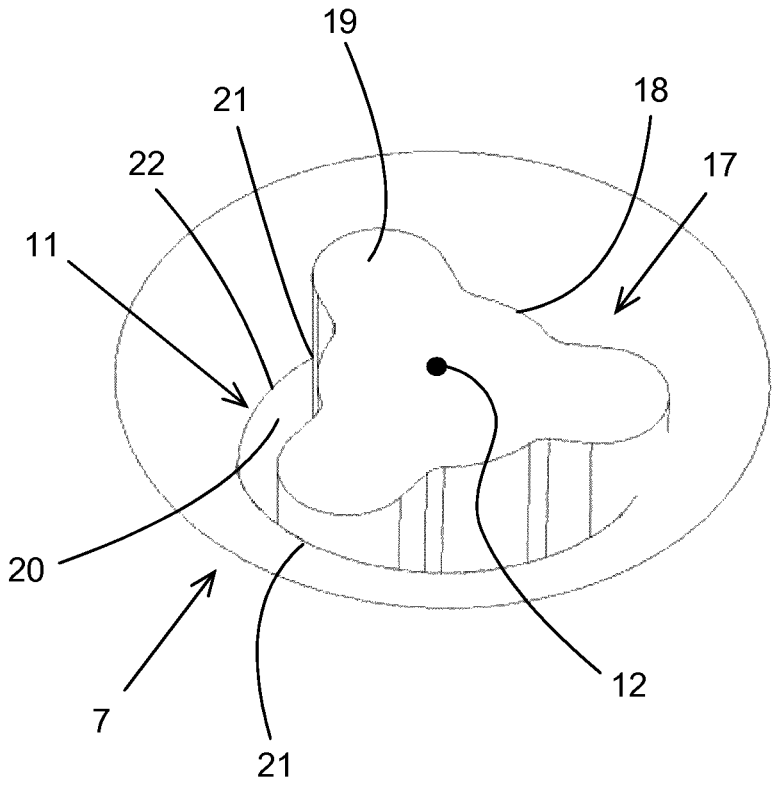
FIG. 6 is a perspective exploded view of a passage of the external cutting element and the pen of the disc-shaped element of the rotary shaver as shown in FIG. 5.

FIGS. 5 and 6 are, respectively, an enlarged cross section of a first embodiment of the pen 17 of the disc-shaped cap 10 and a perspective exploded view of the passage 11 of the external cutting element 7 and the pen 17 of the disc-shaped cap 10.

The pen 17 comprises a central rod 18 with a diameter 2*R1 between 1 and 2 millimetre, for example 1.1 millimetre.

The pen 17 comprises three ribs 19 extending in axial direction parallel to the central axis 12. Each rib 19 extends in radial direction to a radius R2 between 1 and 1.5 millimetre, for example 1.2 millimetre, a width WR between 0.3 and 0.6 millimetre, for example 0.5 millimetre and a height in axial direction between 1 and 3 millimetre, for example 1.5 millimetre. The height of the ribs 19 corresponds to the length of the pen 17.

The ribs 19 are regularly distributed over the circumference of the central rod 18 at an angle of 120 degrees between the ribs 19. Between each two adjacent ribs 19 an axially extending vent 20 is located, which vents 20 extend lengthwise along the pen 17 over the full length of the pen 17. Through the vents 20 air can flow through the passage 11 along the full length of the pen 17.

As can best be seen in FIG. 6, ends 21 of the ribs 19 are located against the wall 22 of the passage 11, whereby a press-fit connection is formed between the pen 17 and the wall 22 of the passage 11. This press-fit connection is achieved by means of a diameter 2*R3 of the passage 11 that is slightly smaller than the diameter 2*R2 of the pen 17 before the pen 17 is inserted into the passage 11, whereby the pen 17 and/or the wall 22 of the passage 11 are elastically deformed during the insertion of the pen 17 into the passage 11. Due to the elastic deformation, the ends 21 of the ribs 19 are pressed against the wall 22 of the passage 11.

In FIG. 3, a large gap 25 is shown between the external surface 13 of the external cutting element 7 and the disc-shaped covering member 14. The gap 25 has a gap height which is equal to the height H of the ring-shaped rim 15.

In FIG. 3, a small gap 23 is shown between the external surface 13 of the external cutting element 7 and the external surface 24 of the rim 15. The gap 23 is designed to be 0 millimetre, but in reality there will be a small gap of less than 0.1 millimetre, created due to surface unevenness and flexure of the main body 14 after the pen 17 has been pressed in. Such a small gap 23 might create crevice corrosion but the effect of the corrosion will be very small because of the endless ring-shaped rim 15.

Figure 7:
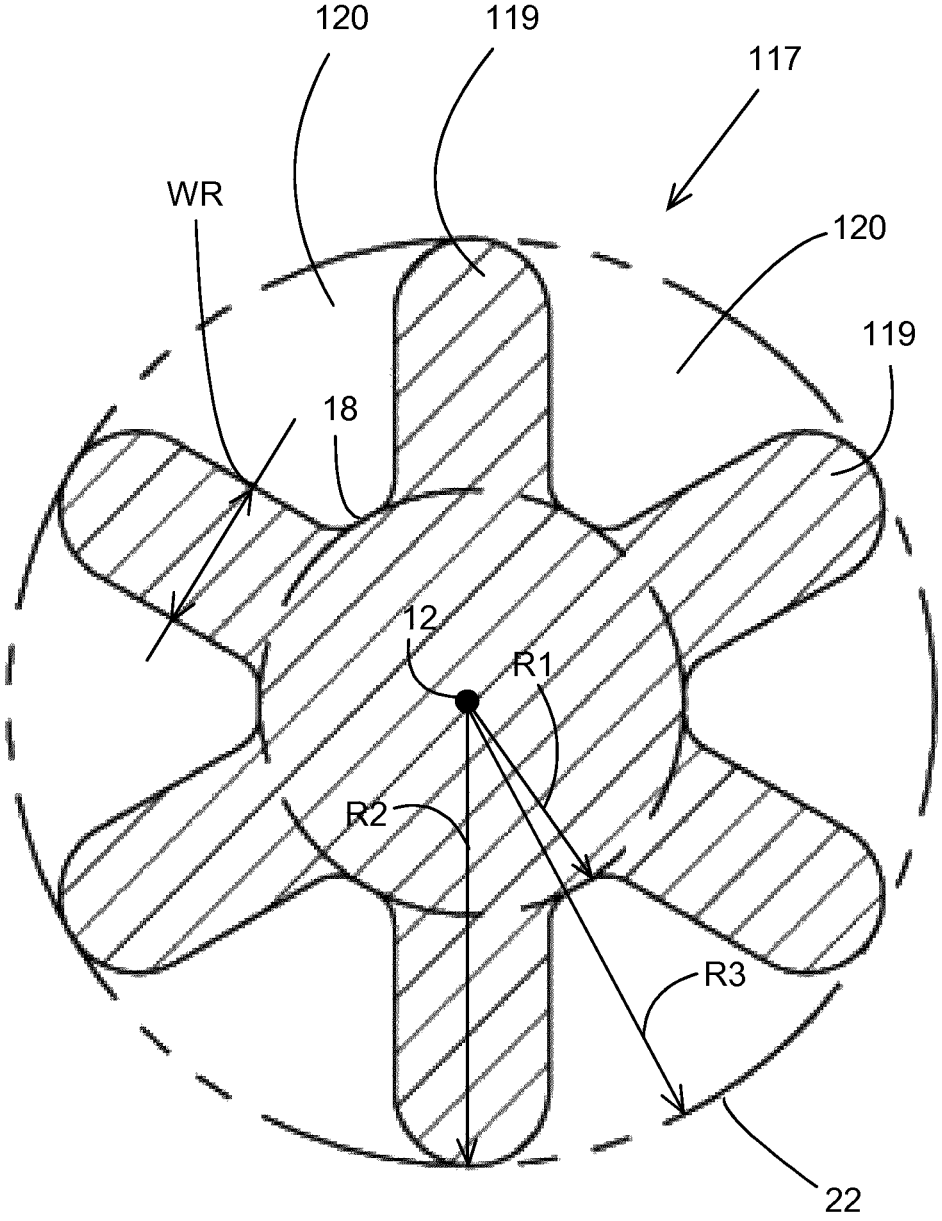
FIG. 7 is an enlarged cross section of a second embodiment of a pen of the disc-shaped element as shown in FIG. 4.

FIG. 7 is an enlarged cross section of a second embodiment of the pen 117 of the disc-shaped cap 10. The pen 117 comprises a central rod 18 with a diameter 2*R1 between 1 and 2 millimetre, for example 1.1 millimetre.

The pen 117 comprises six ribs 119 extending in axial direction parallel to the central axis 12. Each rib 119 extends to a radius R2 between 1 and 1.5 millimetre, for example 1.2 millimetre, a width WR between 0.3 and 0.6 millimetre, for example 0.3 millimetre and a height in axial direction between 1 and 3 millimetre, for example 1.5 millimetre. The height of the ribs 119 corresponds to the length of the pen 117.

By applying more ribs 119, the forces on the wall 22 of the passage 11 are more uniformly distributed.

The ribs 119 are regularly distributed over the circumference of the central rod 18 at an angle of 60 degrees between the ribs 119. Between each two adjacent ribs 119 an axially extending vent 120 is located, which vents 120 extend lengthwise along the pen 117 over the full length of the pen 117. Through the vents 120 air can flow through the passage 11 along the full length of the pen 117.

The cylindrical main body 14 of the disc-shaped cap 10 can have a diameter between 5 and 15 millimetre, for example 10 millimetre, and can have a thickness between 0.3 and 1 millimetre, for example 0.6 millimetre.

The person skilled in the art will realize that the present invention is by no means limited to the preferred embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

LIST OF REFERENCE SIGNS

1 shaver
2 main housing
3 hair-cutting module
4 central shaft member
5 top portion
6 cutting unit
7 external cutting element
8 opening
9 base portion
10 disc-shaped cap
11 cylindrical passage
12 axis
13 external surface
14 disc-shaped covering member
15 ring-shaped rim
16 circumferential edge
17 pen
18 central rod
19 rib
20 vent
21 end
22 wall
23 gap
24 external surface
25 gap
117 pen
119 rib
120 vent
H height
H distance
W width
WR width
2*R1 diameter
R2 radius
2*R3 diameter

The invention claimed is:

1. A rotary shaver, comprising:

an external cutting element including a passage; and a disc-shaped element covering at least part of the external cutting element, wherein the disc-shaped element includes a pen having a length, wherein the pen includes at least three ribs longitudinally extending parallel to the length of the pen, and wherein the at least three ribs are press-fitted in the passage to form at least three vents, wherein each vent is formed by a different area of the wall of the passage and a different pair of adjacent ribs.

2. A rotary shaver according to claim 1, wherein the at least three ribs extend radially with respect to the central axis of the pen.

3. A rotary shaver according to claim 1, wherein the disc-shaped element is made of plastic.

4. A rotary shaver according to claim 1, further comprising:

a raised ring-shaped rim extending between a side surface of the external cutting element facing the disc-shaped element and a side surface of the disc-shaped element facing the external cutting element; and wherein the raised ring-shaped rim has a height (H) of at least 0.1 millimetre in a direction parallel to the length of the pen and a width (W) of less than 0.35 millimetre in a direction perpendicular to the length of the pen.

* * * * *